US005809957A

United States Patent [19]

Antone et al.

[11] Patent Number: 5,809,957

[45] Date of Patent: Sep. 22, 1998

[54] METHOD OF PROLONGING THE LIFE OF GLOW PLUGS

[75] Inventors: James A. Antone, Edwards, Ill.; Martin L. Willi, West Lafayette, Ind.

[73] Assignee: Caterpillar Inc., Peoria, Ill.

[21] Appl. No.: 662,173

[22] Filed: Jun. 12, 1996

[51] Int. Cl.[6] ..... F02B 9/08

[52] U.S. Cl. ..... 123/145 A

[58] Field of Search ..... 123/145 A, 179.3, 123/41.12, 198 R; 60/39.06, 39.82; 219/270; 201/1 T; 431/6, 18, 258

[56] References Cited

U.S. PATENT DOCUMENTS

| | | | |
|---|---|---|---|
| 3,797,242 | 3/1974 | Bowdish | 60/307 |
| 4,541,899 | 9/1985 | Mase et al. | 201/1 T |
| 4,563,568 | 1/1986 | Takizawa | 219/270 |
| 4,762,982 | 8/1988 | Ohno | 219/508 |
| 5,201,803 | 4/1993 | Goto et al. | 60/422 |
| 5,216,983 | 6/1993 | Nilson | 123/41.12 |
| 5,241,821 | 9/1993 | Hoshino | 60/426 |
| 5,287,831 | 2/1994 | Anderson et al. | 123/179.3 |
| 5,291,864 | 3/1994 | Suga et al. | 123/198 |
| 5,367,994 | 11/1994 | Hinkle | 123/145 |
| 5,499,497 | 3/1996 | De Freitas | 60/39.06 |

*Primary Examiner*—Raymond A. Nelli
*Attorney, Agent, or Firm*—Fred J. Baehr

[57] ABSTRACT

A method of prolonging the life of glow plugs comprises the steps of providing a variable displacement pump rotatably connected to a internal combustion engine; driving a hydraulic motor at a generally constant speed with the hydraulic output of the variable displacement pump and directly connecting an alternator to the hydraulic motor to energize the glow plugs with an AC current and voltage and controlling the AC current to maintain a generally constant glow plug temperature from startup and throughout the entire operating range of the internal combustion engine.

4 Claims, 1 Drawing Sheet

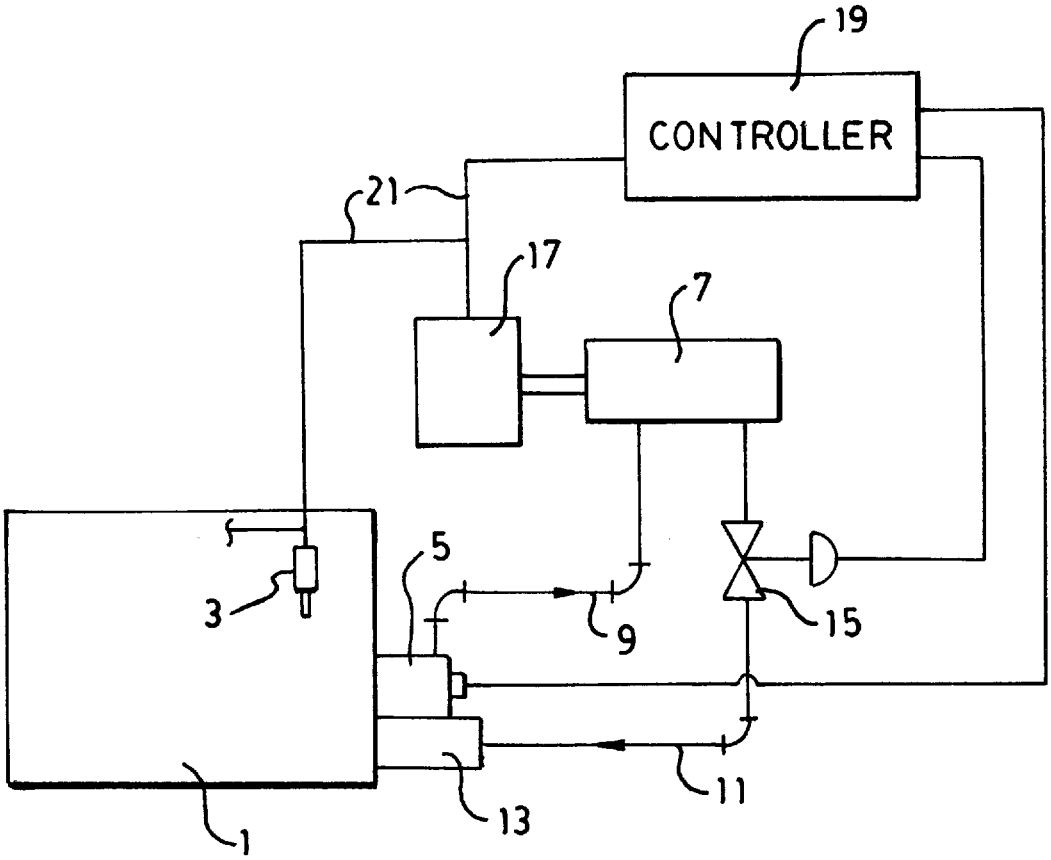
SOLE FIG.

METHOD OF PROLONGING THE LIFE OF GLOW PLUGS

TECHNICAL FIELD

The invention relates to glow plugs for internal combustion engines and more particularly to a method of prolonging the life of glow plugs by providing an engine driven power source to energize the glow plugs from the time the engine starts up until it is shut down.

BACKGROUND ART

Others have recognized the need to apply continuous power to the glow plugs during the period when the internal combustion engine is operating. U.S. Pat. No. 5,367,994 describes a method of maintaining a temperature of at least 1600 degrees F. during the entire period of operation of the engine by providing DC power from a battery and reducing the DC voltage incrementally to prevent draining the battery as resistance heating of the glow plug requires a relatively large quantity of electrical energy.

Recent development of ceramic glow plugs comprising silicon nitride or other suitable ceramic material have resulted in higher temperatures and shorter pre-glow heating time periods. Thus, the glow plugs are not only used for start up, but also make possible the continuation of the combustion process when the combustion pressures are inadequate to sustain combustion and thereby improve combustion efficiency, fuel consumption and help eliminate engine ignition problems. The engine designer can also locate the glow plug to control the location of the initial point of combustion within the cylinders.

SUMMARY OF THE INVENTION

Among the objects of the invention may be noted the provision of a continuous level electrical power source driven by a internal combustion engine to operate glow plugs within each cylinder of the engine from the time of initial start up of the engine until the engine is shut down. The output of the power source is generally constant, while the engine starts slowly and may necessarily operate over a wide range of speeds and loads. Continuous operation of the glow plugs improves engine efficiency, reduces fuel consumption and improves startup, but has resulted in early cracking of the ceramic portions of the glow plugs.

In general, a method of prolonging the life of ceramic glow plugs in accordance with this invention, is characterized by the steps of: providing a source of AC power, connecting the AC power source to the glow plugs, controlling the amount of AC power supplied to the glow plugs to maintain a generally constant temperature of the glow plug from the time the engine is started up until the engine is shut down, whereby the alternating current changing direction every half cycle eliminates ion migration within the ceramic portion of the glow plug, and thus prevents cracking of the ceramic portion of the glow plugs and prolonging the life of the glow plugs.

The steps of providing the AC power source comprises providing a hydraulic pump driven by the engine; providing a hydraulic motor hydraulically connected to and driven by hydraulic fluid from the hydraulic pump; providing an alternator rotatably connected to the hydraulic motor and electrically connected to the glow plugs to provide AC power thereto; providing a controller operable to regulate the flow of hydraulic fluid from the hydraulic pump to the hydraulic motor to drive the alternator at a generally constant speed from engine start up and throughout the entire range of engine operating speeds, and to maintain a generally constant glow plug temperature during the entire operating range of the internal combustion engine.

BRIEF DESCRIPTION OF THE DRAWINGS

The invention as set forth in the claims will become more apparent by reading the following detailed description in conjunction with the accompanying drawing, wherein:

The sole figure is a schematic view of a internal combustion engine and a system for supplying AC power to maintain glow plugs disposed therein at a constant temperature from the time the engine is started up until the engine is shut down.

DESCRIPTION OF THE PREFERRED EMBODIMENT

Referring now to the sole figure, there is shown a schematic view of a internal combustion engine 1 with a plurality of glow plugs 3 comprising a ceramic portion made of silicon nitrite or other suitable ceramic material disposed therein, only one glow plug 3 is shown.

A variable displacement pump 5 is mounted on the engine 1 and is rotatably connected thereto. A hydraulic motor 7 is connected to the hydraulic pump 5 by a supply hydraulic conduit 9 and a return conduit 11, which is connected to and discharges into a hydraulic fluid reservoir 13 disposed adjacent the variable displacement pump 5. A throttle or other type of control valve 15 is disposed in the return conduit down stream of the hydraulic motor 5. An alternator 17 is rotatably connected to and driven by the hydraulic motor 7 at a generally constant speed. The alternator 17 and a controller 19 are electrically connected to the glow plugs 3 by the electrical lines 21. The controller 19 is also connected to the variable displacement pump 5 by the line 23 and to the control valve 15 by the line 25.

The operation of the system is as follows; the variable displacement pump 5 is rotatably connected to the engine 1, takes its suction from the hydraulic reservoir 13 and begins to supply hydraulic fluid to the hydraulic motor 7 via the supply conduit 9 immediately as the engine 1 is cranked at a speed of about 125 to 150 RPM. The variable displacement pump 5 continues to supply hydraulic fluid to the hydraulic motor 7 throughout the entire operating speed range of the engine generally at a pressure of 3000 psi and at a generally at a constant volume as the output of the variable displace pump 5 is generally independent of engine speed or the speed at which it is operated . The motor 7 being supplied with hydraulic fluid at a generally constant volume and pressure runs at a generally constant speed. The hydraulic motor 7 being rotatably connected to the alternator, drives the alternator 17 at a generally constant speed independent of engine speed to produce an AC current and voltage sufficient to energizes and heat the glow plugs 3 at start up to ignite the fuel and run the engine 1. To maintain a predetermined glow plug temperature over the entire operating range of the engine 1, the controller 19 responds to the resistance of the glow plugs 3, or an electronic engine control map based on engine operating conditions, to control the variable displacement pump 5 and fine tunes the energy output of the alternator 17 by operating the throttle valve 15 to increase the back pressure on the hydraulic motor 7 and reduce the power output of the alternator 17 as the engine heats up. Thus the controller 19 maintains the glow plugs 3 at a constant temperature over the entire operating range of the internal combustion engine 1 from the time the engine 1 is started until the time the engine 1 is shut down.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

The ceramic glow plugs provide resistance to corrosion, ability to withstand high temperatures, pressure and shock loads, but when powered during the entire operating cycle from a DC source, an electrical field setup by the direct current causes ion migration in ceramic materials such as silicon nitride. In time this ion migration results in cracking of the ceramic material and failure of the glow plugs. By providing a source of AC power, the current changes direction every half cycle so the duration of the electrical field pointing in one direction is short and the electrical field reverses itself every half cycle. Therefore, there is essentially no ion migration within the ceramic material and cracking from ion migration is eliminated prolonging the life of the glow plugs.

Utilizing a variable displacement hydraulic pump, which operates a hydraulic motor coupled to an alternator provides a reliable AC power supply, which operates independent of engine speed and does not require the use of DC power from the batteries prior to startup.

What is claimed is:

1. A method of prolonging the life of glow plugs comprising a ceramic portion utilized in an internal combustion engine characterized by the steps of:

providing a source of AC power, connecting the AC power source to the glow plugs, providing a controller responsive to the resistance of the glow plugs to control the amount of AC power supplied to the glow plugs to maintain a generally constant temperature of the glow plugs from the time the engine is started up until the engine is shut down, whereby the alternating current changing polarity every half cycle eliminates ion migration within the ceramic portion of the glow plugs, thus preventing cracking of the ceramic portion of the glow plugs and prolonging the life of the glow plugs.

2. The method of prolonging the life of glow plugs as set forth in claim 1, further characterized by the steps of:

providing a hydraulic pump driven by the engine;

providing a hydraulic motor hydraulically connected to and driven by hydraulic fluid from the hydraulic pump;

providing an alternator rotatably connected to the hydraulic motor and electrically connected to the glow plugs to provide AC power thereto;

providing a controller operable to regulate the flow of hydraulic fluid from the hydraulic pump to the hydraulic motor to drive the alternator at a generally constant speed from engine start up and throughout the entire range of engine operating speeds, and to maintain a generally constant glow plug temperature during the entire operating cycle of the internal combustion engine;

changing direction of the current every half cycle eliminates ion migration within the ceramic portion of the glow plug, thus preventing cracking of the ceramic portion of the glow plugs and prolonging the life of the glow plugs.

3. The method of prolonging the life of glow plugs as set forth in claim 2, further characterized by the step of:

providing a variable displacement hydraulic pump driven by the engine and controlled to deliver hydraulic fluid to the hydraulic motor at a generally constant flow and pressure from the time the engine is started up until the engine is shut down to drive the alternator at a generally constant speed and power output.

4. The method of prolonging the life of glow plugs as set forth in claim 3, further characterized by the step of:

providing a control valve down stream of the hydraulic motor, and having the controller operate the control valve to assist in controlling the power output of the alternator to maintain the glow plugs at a constant temperature.

* * * * *